US010144021B2

(12) United States Patent
Tinsley et al.

(10) Patent No.: US 10,144,021 B2
(45) Date of Patent: Dec. 4, 2018

(54) CONTAINER WITH IMPROVED LIQUID DISPENSING ABILITY

(71) Applicants: Michael Tinsley, Lexington, KY (US); Toni M. Robinson-Smith, Cincinnati, OH (US)

(72) Inventors: Michael Tinsley, Lexington, KY (US); Toni M. Robinson-Smith, Cincinnati, OH (US)

( * ) Notice: Subject to any disclaimer, the term of this patent is extended or adjusted under 35 U.S.C. 154(b) by 0 days.

(21) Appl. No.: 14/966,849

(22) Filed: Dec. 11, 2015

(65) Prior Publication Data

US 2017/0165693 A1 Jun. 15, 2017

(51) Int. Cl.

| | |
|---|---|
| ***B05B 11/00*** | (2006.01) |
| ***B05B 15/00*** | (2018.01) |
| ***B05B 15/30*** | (2018.01) |

(52) U.S. Cl.

CPC ..... *B05B 11/0037* (2013.01); *B05B 11/0059* (2013.01); *B05B 15/30* (2018.02); *B05B 11/3011* (2013.01)

(58) Field of Classification Search

CPC ..... B05B 11/0037; B05B 11/0059; B05B 11/3001; B05B 11/3052; B05B 11/3057; B05B 15/005

USPC ..... 222/211, 321.5, 372, 377, 382, 464.7, 222/585

See application file for complete search history.

(56) References Cited

U.S. PATENT DOCUMENTS

| | | | | |
|---|---|---|---|---|
| 2,564,400 | A | 8/1951 | Victor | |
| 2,950,031 | A | 8/1960 | Abplanalp et al. | |
| 4,436,224 | A | 3/1984 | McInerny | |
| 4,470,526 | A | 9/1984 | Cha et al. | |
| 4,667,846 | A | 5/1987 | Marceau | |
| 4,801,049 | A | 1/1989 | Thompson | |
| 4,826,031 | A * | 5/1989 | Rusgitti | B05B 11/0037 220/4.21 |
| 5,062,549 | A | 11/1991 | Smith et al. | |
| 5,076,424 | A | 12/1991 | Nakamura | |
| 5,123,573 | A | 6/1992 | Kucherer | |
| 5,148,948 | A | 9/1992 | Granville et al. | |
| 5,226,600 | A | 7/1993 | Frank | |
| 5,366,119 | A | 11/1994 | Kline | |
| 5,749,500 | A * | 5/1998 | Kraus | B65D 25/02 222/377 |
| 5,897,032 | A | 4/1999 | Ellion et al. | |
| 6,257,446 | B1 | 7/2001 | Pike | |

(Continued)

*Primary Examiner* — Nicholas J Weiss

(74) *Attorney, Agent, or Firm* — Porter Wright Morris & Arthur LLP

(57) ABSTRACT

A container comprises a receptacle, a manually-operated positive displacement dispensing nozzle, and a draw tube extending from the nozzle. The receptacle includes an upper body wall and an intermediate body wall connected by a first curved wall, and a lower sump wall connected with the intermediate body wall by a second curved wall. The lower sump wall and a bottom wall are connected by a third curved wall. The second curved wall, the lower sump wall, the third curved wall and the bottom wall form a sump into which the draw tube lower end extends to a midpoint. The volume of the sump below the midpoint is substantially equal to the volume of the sump above the midpoint, the draw tube end is spaced substantially equal distance from the surrounding lower sump wall, and the volume of the sump is about three times the volume of the draw tube.

15 Claims, 5 Drawing Sheets

(56) References Cited

U.S. PATENT DOCUMENTS

| | | | | |
|---|---|---|---|---|
| 6,431,405 | B2 | 8/2002 | Irwin | |
| 6,648,201 | B1 | 11/2003 | Marinaro et al. | |
| 6,752,297 | B1 | 6/2004 | Ische | |
| 8,091,741 | B2 | 1/2012 | Pritchard | |
| 9,433,958 | B2 * | 9/2016 | Kim | A47K 5/1205 |
| 2001/0030203 | A1 | 10/2001 | Weber | |
| 2001/0032864 | A1 | 10/2001 | Shepherd | |
| 2004/0134938 | A1 * | 7/2004 | Shand | B05B 11/0037 222/377 |
| 2006/0186144 | A1 | 8/2006 | Tinsley | |
| 2007/0181605 | A1 * | 8/2007 | Yang | B05B 15/005 222/321.5 |
| 2008/0315018 | A1 * | 12/2008 | Withers | B05B 11/0037 239/526 |
| 2009/0008414 | A1 | 1/2009 | Tingsley | |
| 2009/0294468 | A1 * | 12/2009 | Tom | B05B 11/0037 222/1 |
| 2011/0108580 | A1 * | 5/2011 | Koh | B05B 11/0037 222/377 |
| 2014/0008395 | A1 * | 1/2014 | Syed | B05B 11/3042 222/321.5 |

* cited by examiner

CONTAINER WITH IMPROVED LIQUID DISPENSING ABILITY

FIELD OF THE INVENTION

The present invention is directed to a container with improved liquid dispensing ability. More specifically, the invention is directed to a container including a manually-operated positive displacement dispensing nozzle and allowing reliable dispensing of virtually an entire amount of liquid from the container.

BACKGROUND OF THE INVENTION

Numerous dispensing containers are known in the art for use in dispensing liquid products. Containers with trigger-actuated dispensers or pump-actuated dispensers are commonly used for dispensing liquids such as cleaning products, beauty products and the like in spray or liquid stream forms. However, it typically is difficult to remove the entire amount of liquid from a container using such dispensers as the dispensing action deteriorates as the liquid level decreases. Often, the dispensing action results in misfiring, foaming or oozing, especially when the container contents are low and/or the container is tilted to spray a horizontal surface. Unfortunately, to remove a last portion of liquid from such containers, the dispenser is typically removed and the final contents are poured from the container. Alternatively, when the dispenser cannot be easily or conveniently removed, such containers are discarded with the last portion of liquid going unused, resulting in product waste.

Accordingly, a need exists for an improved container which reliably dispenses an entire amount of liquid from the container and, importantly, avoids the waste of product which has been associated with conventional trigger- and pump-actuated containers when a last portion of liquid agent cannot be removed.

SUMMARY OF THE INVENTION

It is therefore an object of the invention to provide a container with improved liquid dispensing ability.

In one embodiment, the container of the invention comprises (a) a receptacle for holding a liquid, (b) a neck arranged at the top of the receptacle, the neck having a smaller diameter than a largest diameter of the receptacle and provided with an opening; (c) a manually-operated positive displacement dispensing nozzle for dispensing liquid from the container, arranged to cover the opening; and (d) a draw tube extending from the dispensing nozzle, through the opening, and into the receptacle. The receptacle includes (i) an upper, vertically arranged body wall, (ii) an intermediate, inwardly slanted body wall, (iii) a lower, vertically arranged sump wall, and (iv) a bottom wall. The upper body wall and the intermediate body wall are connected by a first curved wall, the intermediate body wall and the lower sump wall are connected by a second curved wall, and the lower sump wall and the bottom wall are connected by a third curved wall. The second curved wall, the lower sump wall, the third curved wall and the bottom wall form a sump. The draw tube has a lower end which extends into the sump to a midpoint at which the volume of the sump below the draw tube end is substantially equal to the volume of the sump above the draw tube end, the draw tube end is spaced substantially equal distance from the surrounding lower sump wall, and the volume of the sump is about three times the volume of the draw tube.

The container presents the liquid for dispensing in a manner which maintains positive liquid pressure in the draw tube and the manually-operated positive displacement dispensing nozzle, even when only a small amount of liquid is present in the container and even when the container is tilted during the dispensing action, for example to deliver liquid to a horizontal surface. These and additional advantages of the container of the invention will be more fully apparent in view of the following detailed disclosure.

BRIEF DESCRIPTION OF THE DRAWINGS

The container of the invention will be more fully understood in view of the drawings, which are illustrative only and non-limiting of the invention as described herein, in which.

Figure 1:
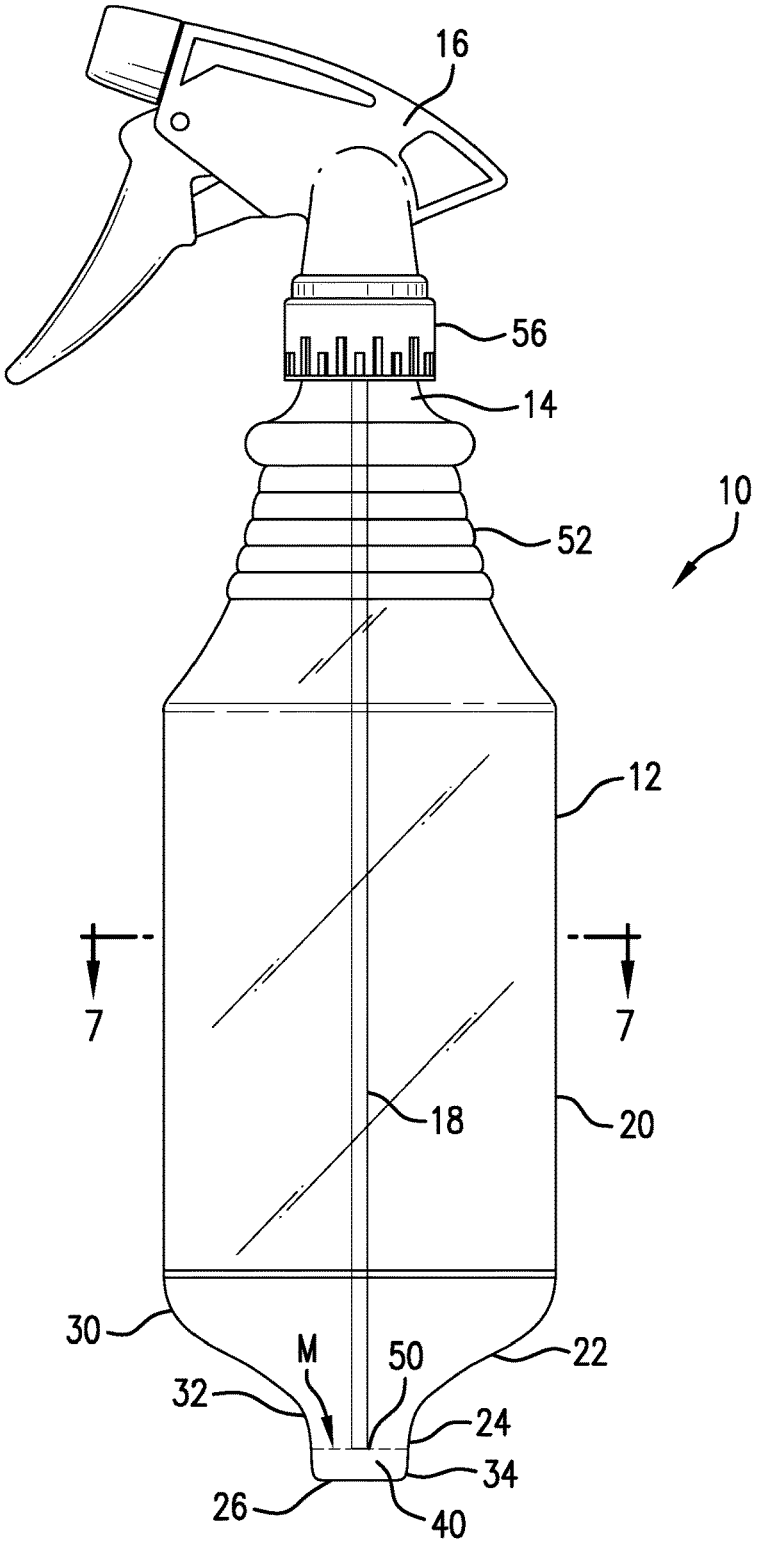
FIG. 1 shows a front schematic view of a first embodiment of a container according to the invention.

Various features of the embodiments presented in the drawing will be more fully understood in view of the following detailed description.

DETAILED DESCRIPTION

The present invention is directed to a container with improved liquid dispensing ability. More specifically, the invention is directed to a container including a manually-operated positive displacement dispensing nozzle, a draw tube and a sump-including receptacle which cooperate to present the liquid for dispensing in a manner which maintains positive liquid pressure in the draw tube and the manually-operated positive displacement dispensing nozzle, even when only a small amount of liquid is present in the container and even when the container is tilted during the dispensing action, for example to deliver liquid to a horizontal surface. Within the present disclosure, maintaining "positive liquid pressure" or "positive pressure" refers to the ability to maintain a stream of liquid without interruption of the pressure along the length of the liquid stream, i.e., in the draw tube and the dispensing nozzle.

Figure 6:
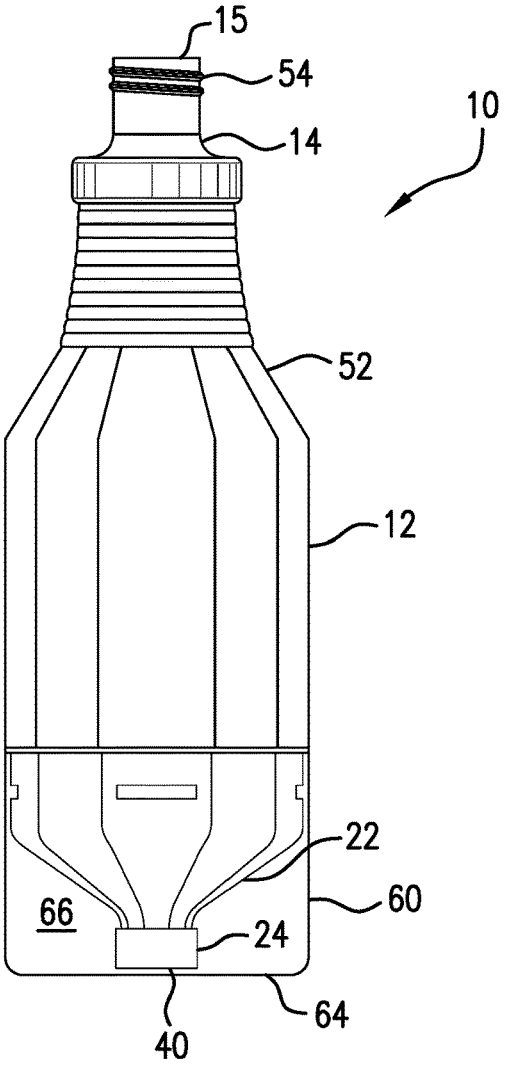
FIG. 6 shows a front schematic view of another embodiment of a container according to the invention, with the dispensing nozzle removed.

FIG. 1 shows a schematic view of a first embodiment of a container 10 according to the invention adapted for holding and dispensing a liquid. The container is vertically oriented as shown in FIGS. 1 and 6. In one embodiment, the container is suitably formed of polymer materials and the different parts thereof may be formed by any method known in the art, including injection molding, blow molding, or the like. The polymer materials may be transparent or opaque and, in FIG. 1, the container receptacle is transparent to show the draw tube within the receptacle. The container polymer material may be selected from those materials known in the art with consideration of the compatibility with the liquid intended to be contained therein, mechanical strength requirements, recyclability, and the like. Examples include, but are not limited to polyolefins such as polyethylene (high or low density), polypropylene, and copolymers thereof, polyesters such as polyethylene terephthalate, polyvinyl chloride, polyvinylidene chloride and the like. In alternate embodiments, the container, or parts thereof, made be formed of glass or metal.

The container 10 includes a receptacle 12 for holding a liquid. Generally, the container may be used to dispense any desired liquid, including cleaning liquids, personal care/beauty products in liquid form, cooking liquids or food components, and the like. The container 10 further includes a neck 14 arranged at the top of the receptacle, provided with an opening 15, as better shown in FIG. 6, and a manually-operated positive displacement dispensing nozzle 16 for dispensing liquid from the container and arranged to cover the opening 15. The container 10 also includes a draw tube 18 which extends from the dispensing nozzle 16, through the opening 15, and into the receptacle 12, and supplies liquid to the dispensing nozzle.

The receptacle 12 includes defined elements which cooperate with the dispensing nozzle and the draw tube to obtain various advantages of the inventive container. As shown in FIGS. 1 and 6, the receptacle includes an upper, vertically arranged body wall 20, an intermediate, inwardly slanted body wall 22, a lower, vertically arranged sump wall 24, and a bottom wall 26. Inwardly slanted in this context refers to the inclination of the intermediate wall towards the interior of the receptacle as it extends from the upper body wall to the lower sump wall. The upper body wall 20 and the intermediate body wall 22 are connected by a first curved wall 30, the intermediate body wall 22 and the lower sump wall 24 are connected by a second curved wall 32, and the lower sump wall 24 and the bottom wall 26 are connected by a third curved wall 34. The second curved wall 32, the lower sump wall 24, the third curved wall 34 and the bottom wall 26 form a sump 40. The configuration of the receptacle walls directs liquid to the sump, even as the amount of liquid in the container decreases and/or when the container is titled with respect to the vertical orientation shown in FIGS. 1 and 6, for example, when the container is tilted toward a horizontal surface to dispense liquid.

Figure 2:
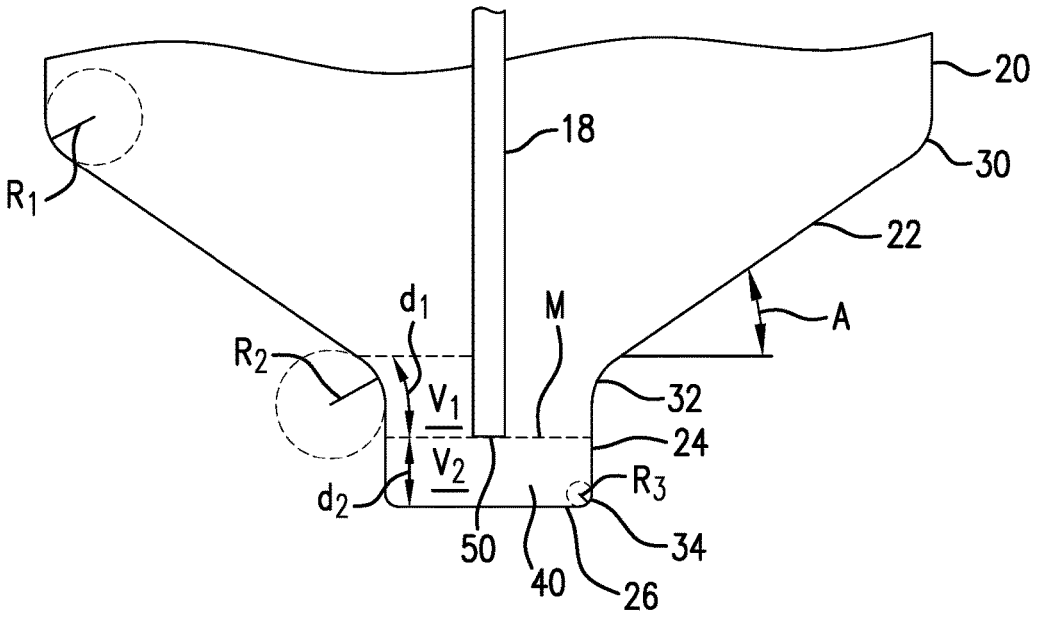
FIG. 2 shows a front schematic enlarged view of the lower portion of the container of FIG. 1.

In a specific embodiment, the angle of inclination, A, as shown in FIG. 2, of the intermediate body wall 22 may vary, for example, within a range of from about 10 to about 70 degrees from the horizontal, more specifically from about 10 to about 50 degrees, or even more specifically, from about 10 to about 30 degrees. In a more specific embodiment, the intermediate body wall 22 is inclined at an angle of about 20 degrees from the horizontal.

The curved walls 30, 32 and 34 allow for smooth flow of liquid to the lower portion of the receptacle, along the intermediate portion and into the sump, avoiding or significantly reducing emulsification and air bubbles which can occur when liquids flow over or around sharp angled corners. Such emulsification and/or bubbles can contribute to pressure loss in a liquid stream, resulting in misfiring, foaming, and/or oozing, especially when the container is repeatedly tilted back and forth in use, and are substantially avoided in the present container.

As shown in FIGS. 1 and 2, the draw tube 18 has a lower end 50 which extends into the sump 40 to a midpoint M at which the volume of the sump below the draw tube end, $V_2$, is substantially equal to the volume of the sump above the draw tube end, $V_1$. Additionally, the draw tube end 18 is spaced substantially equal distance from the surrounding lower sump wall 24, and the volume of the sump 40, $V_1+V_2$, is about three times the volume of the draw tube 18. In a specific embodiment, the volume of the draw tube is about 1 ml and the volume of each of $V_1$ and $V_2$ is about 1.5 ml. As such, the sump-including receptacle cooperates with the draw tube to present the liquid for dispensing in a manner which maintains positive liquid pressure of the liquid in the draw tube and the manually-operated positive displacement dispensing nozzle during a dispensing action. Liquid is dispensed without misfiring, foaming or oozing, even when the container contents are low and/or the container is repeatedly tilted to spray a horizontal surface. In a more specific embodiment, a distance, $d_1$, from an edge of the second curved wall adjacent the intermediate body wall to the height of the midpoint is substantially equal to the distance, $d_2$, from the height of the midpoint to the bottom wall of the sump to further improve presentation of the liquid to the draw tube for dispensing with maintained positive pressure.

Figure 8:
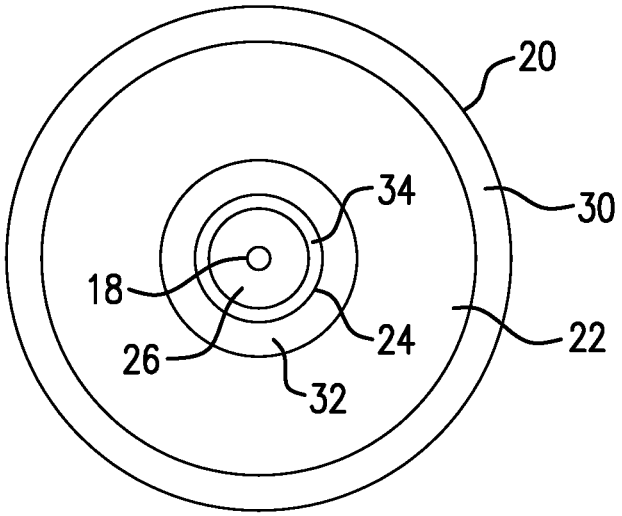
FIG. 8 shows a schematic view of a horizontal cross-section taken along line 1-1 in the container of FIG. 1.

The respective walls of the receptacle may be configured uniformly or non-uniformly of any desired horizontal cross-section when viewed from the top or the bottom of the container. In a specific embodiment, one or more walls of the receptacle have a circular horizontal cross-section. When the intermediate wall has a circular horizontal cross-section, the intermediate wall has a truncated cone configuration, as shown in FIG. 1. When the upper body wall and the lower sump wall have circular horizontal cross-sections, respectively, the walls are cylindrical in shape. In a specific embodiment, as shown in FIG. 1, all of the upper body, intermediate, sump and curved walls of the receptacle have a circular horizontal cross-section. FIG. 8 shows a schematic cross-sectional view of such a container, taken along line 9-9 in FIG. 1. In another embodiment, one or more walls of the receptacle have a polygonal horizontal cross-section. When the intermediate wall has a polygonal horizontal cross-section, the intermediate wall has a truncated pyramid configuration, as shown in FIG. 6. When the upper body wall and the lower sump wall have polygonal horizontal cross-sections, respectively, the walls may be of any of a variety of cooperating polyhedron shapes. In a specific embodiment, the upper body wall is prism shaped, as shown in FIG. 6. In yet another embodiment, one or more of the walls of the receptacle may have a horizontal circular cross-section and one or more additional walls of the receptacle may have a horizontal polygonal cross section. In additional embodiments, one or more of the walls of the receptacle may have a horizontal cross-section including one or more curves and one or more straight sections.

Figure 7:
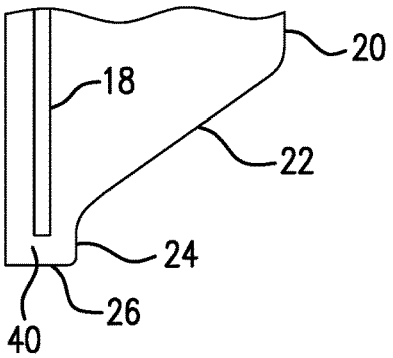
FIG. 7 shows a front schematic view of another embodiment of a lower portion of a container according to the invention.

In the container of FIG. 1, the draw tube 18 is arranged along a longitudinal axis of the receptacle 12. Alternatively, the draw tube may be offset from a longitudinal axis of the receptacle, as shown in FIG. 7, for example when the receptacle is non-symmetrical about a longitudinal axis of the receptacle, i.e., the receptacle has a non-symmetrical shape.

The lengths of various elements of the container, if not described herein, can be varied. Those skilled in the art can size the respective walls of the receptacle to meet the noted functional relationships of the sump and draw tube. In one specific embodiment, and with reference to FIG. 2, for a container having a height of about 10-12 inches, the first and second curved walls 30 and 32 each have a radius of curvature, $R_1$ and $R_2$, respectively, in the range of about 0.2 to about 0.6 inches, more specifically in the range of about 0.3 to about 0.4 inches. In another specific embodiment, the third curved wall 34 has a radius of curvature, $R_3$, in the range of about 0.01 to about 0.15 inches, more specifically in the range of about 0.05 to about 0.10 inches. In another specific embodiment, the bottom wall 26 has a surface area which is at least 90% less than a surface area of a cross section of the receptacle at the upper body wall 20.

The neck 14 arranged at the top of the receptacle may be of any desired diameter which is smaller than the largest diameter or other horizontal cross-section length of the receptacle. In a specific embodiment, as shown in FIG. 1, the diameter of the neck is less than that of the upper body wall 20, and the upper body wall 20, is connected with the neck 14 via a top wall 52. In a more specific embodiment, the diameter of neck 14 may be less than about a half, a third or a quarter of the largest diameter or other horizontal cross-section length of the receptacle. In another specific embodiment, the dispensing nozzle 16 is removably attached to the neck of the receptacle, for example, by screw threads 54 on the neck as shown in FIG. 6 and similar screw threads (not shown) on a screw cap 56 included with the dispensing nozzle, by a snap fit, or the like.

Figure 5:
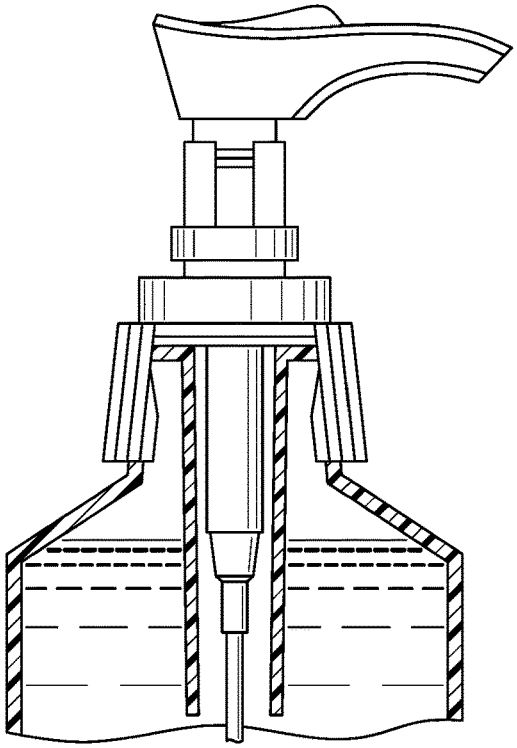
FIG. 5 shows a front partial cross sectional view of an alternate dispensing nozzle embodiment of a container according to the invention.

The manually-operated positive displacement dispensing nozzle may be of any configuration known in the art in which manual application of pressure causes a first amount of liquid to be dispensed from the nozzle and a second amount of liquid to be drawn from the sump to the nozzle via the draw tube. Generally, a manually-operated positive displacement dispensing nozzle is an open system and comprises an actuator for pivoting or reciprocal movement, a pump chamber provided with a pump piston connected to the actuator for reciprocating movement therein in response to movement of the actuator. The reciprocating movement of the pump piston alternately draws fluid from the container into the pump chamber and then forces the fluid out of the pump chamber and through the nozzle in a spray or stream. A venting system allows air to enter the receptacle as the dispensing nozzle dispenses liquid from the container. The cooperation of the defined receptacle, draw tube and manually-operated positive displacement dispensing nozzle maintains positive pressure of liquid within the dispensing nozzle and the draw tube to avoid misfiring, foaming or oozing, especially when the container contents are low and/or the container is tilted to spray a horizontal surface. The manual application of pressure may be made through a trigger-actuated dispenser as shown in FIG. 1 or a pump-actuated dispenser as shown in FIG. 5.

Advantageously, the dispensing nozzle may be oriented on the container to dispense liquid in a direction perpendicular to the vertical orientation of the receptacle. As a result, a user may typically tilt the receptacle at an angle with respect to the vertical orientation to aim the dispensing nozzle towards a horizontal surface. In conventional dispensing containers, such tilting can result in misfiring, foaming or oozing during dispensing, especially when the container contents are low. However, the inventive container, by maintaining a positive liquid pressure in the draw tube and dispensing nozzle, provides reliable liquid delivery, without misfiring, foaming and oozing. The inventive container also allows delivery of virtually all liquid from the container, thereby reducing liquid product waste and inconvenient tactics commonly employed in order to use the entire contents of a conventional spray container.

Figure 3:
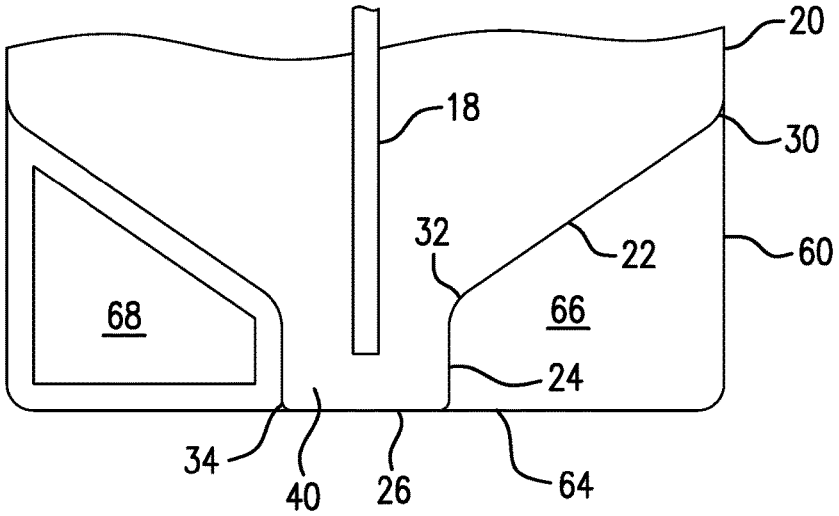
FIG. 3 shows a front schematic view of the lower portion of a container according to the invention, further including a first embodiment of a base member.

The container may further include a removable or non-removable base portion arranged on an exterior of the receptacle to enclose a portion of the receptacle and/or to support the receptacle. For example, as shown in FIGS. 3 and 6, the container may include a base portion 60 which encloses the intermediate wall 22 and the sump 40 of the receptacle and provides an enlarged bottom surface 64 on which the container may stand. The base portion 60 may be attached to the receptacle by any suitable means including, but not limited to, a snap fit, screw threads, adhesive, melt bonding, or the like. If desired, the space 66 between the wall of the base portion 60 and the sump 40 and intermediate wall 22 may be used for storage of one or more accessories, for example, cleaning pads or cloths, or the like. Access to space 66 may be through removal of a removable base portion 60, through an access door 68 in the wall of base portion 60 (as shown in FIG. 3), or the like.

Figure 4:
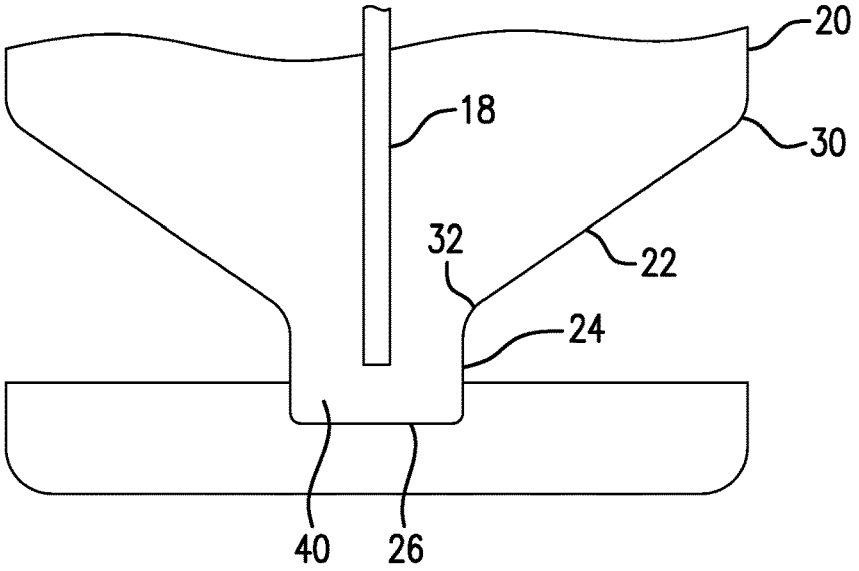
FIG. 4 shows a front schematic view of the lower portion of a container according to the invention, further including a second embodiment of a base member.

In an alternate embodiment, the receptacle is provided on a pedestal 70 as shown in FIG. 4. The pedestal may be formed integral with the receptacle, permanently adhered to the receptacle, for example with adhesive, by melt bonding, or the like, or may be removably attached to the receptacle in the area of the sump, for example, by a snap fit, screw threading, or the like.

The specific embodiments and examples described herein are exemplary only in nature and are not intended to be limiting of the invention defined by the claims. Further embodiments and examples, and advantages thereof, will be apparent to one of ordinary skill in the art in view of this specification and are within the scope of the claimed invention.

What is claimed is:

1. A dispenser, comprising (a) a receptacle for holding a liquid, wherein the receptacle includes (i) an upper, vertically arranged body wall, (ii) an intermediate, inwardly slanted body wall, wherein the intermediate body portion is arranged at an angle in a range of from 10 to 30 degrees with respect to the horizontal, (iii) a lower, vertically arranged sump wall, and (iv) a bottom wall, wherein the upper body wall and the intermediate body wall are connected by a first curved wall, the intermediate body wall and the lower sump wall are connected by a second curved wall, and the lower sump wall and the bottom wall are connected by a third curved wall, wherein the first and second curved walls have a radius of curvature of 0.2 to 0.6 inches and the third curved wall has a radius of curvature of 0.01 to 0.15 inches, and wherein the second curved wall, the lower sump wall, the third curved wall and the bottom wall form a sump;

(b) a neck arranged at the top of the receptacle, the neck having a smaller diameter than a largest diameter of the receptacle, the neck being provided with an opening;

(c) a manually-operated positive displacement trigger-actuated dispensing nozzle for dispensing liquid from the dispenser, arranged to cover the opening; and (d) a draw tube extending from the dispensing nozzle, through the opening, and into the receptacle, wherein the draw tube has a lower end which extends into the sump to a midpoint at which the volume of the sump below the draw tube end is equal to the volume of the sump above the draw tube end, wherein the draw tube end is spaced equal distance from the surrounding lower sump wall, and wherein the volume of the sump is three times the volume of the draw tube.

2. The dispenser of claim 1, wherein the receptacle further includes a top wall connecting the upper body wall and the neck.

3. The dispenser of claim 1, wherein the sump is arranged along a longitudinal axis of the receptacle.

4. The dispenser of claim 1, wherein the sump is offset from a longitudinal axis of the receptacle.

5. The dispenser of claim 1, wherein the bottom wall has a surface area which is at least 90% less than a surface area of a cross section of the receptacle at the upper body wall.

6. The dispenser of claim 1, wherein the dispensing nozzle is removably attached to the neck of the receptacle.

7. The dispenser of claim 1, wherein the dispensing nozzle includes a screw cap which removably attaches to screw threads on the neck of the receptacle.

8. The dispenser of claim 1, wherein the dispensing nozzle is oriented to dispense liquid in a direction perpendicular to the vertically arranged walls of the receptacle, whereby aiming the dispensing nozzle to dispense liquid agent towards a horizontal surface results in tilting of the receptacle at an angle with respect to a vertical.

9. The dispenser of claim 1, further comprising a base portion arranged on an exterior of the receptacle and enclosing the sump and the intermediate body portion.

10. The dispenser of claim 1, further comprising a pedestal on which the receptacle is provided.

11. The dispenser of claim 1, wherein the intermediate body portion has a truncated conical configuration.

12. The dispenser of claim 1, wherein the intermediate body portion has a truncated pyramidal configuration.

13. The dispenser of claim 1, wherein a distance from an edge of the second curved wall adjacent the intermediate body wall to the height of the midpoint is substantially equal to the distance from the height of the midpoint to the bottom wall of the sump.

14. A method of dispensing liquid from a dispenser which comprises (a) a receptacle holding the liquid, wherein the receptacle includes (i) an upper, vertically arranged body wall, (ii) an intermediate, inwardly slanted body wall arranged at an angle of from 10 to 30 degrees with respect to the horizontal, (iii) a lower, vertically arranged sump wall, and (iv) a bottom wall, wherein the upper body wall and the intermediate body wall are connected by a first curved wall, the intermediate body wall and the lower sump wall are connected by a second curved wall, and the lower sump wall and the bottom wall are connected by a third curved wall, wherein the first and second curved walls have a radius of curvature of 0.2 to 0.6 inches and the third curved wall has a radius of curvature of 0.01 to 0.15 inches, and wherein the second curved wall, the lower sump wall, the third curved wall and the bottom wall form a sump;

(b) a manually-operated positive displacement trigger-actuated dispensing nozzle for dispensing the liquid from the dispenser; and (c) a draw tube extending from the dispensing nozzle, wherein the draw tube has a lower end which extends into the sump to a midpoint at which the volume of the sump below the draw tube end is equal to the volume of the sump above the draw tube end, wherein the draw tube end is spaced equal distance from the surrounding lower sump wall, and wherein the volume of the sump is three times the volume of the draw tube, the method comprising manually actuating the trigger-actuated dispensing nozzle to draw liquid from the sump, with positive liquid pressure being maintained in the draw tube.

15. The method of claim 14, wherein the dispensing nozzle is oriented to dispense liquid in a direction perpendicular to the vertically arranged walls of the receptacle, and the method comprises aiming the dispensing nozzle to dispense liquid agent towards a horizontal surface by tilting the receptacle at an angle with respect to a vertical, with liquid being maintained in the sump and positive liquid pressure being maintained in the draw tube.

* * * * *